US008324822B2

(12) United States Patent
Peng

(10) Patent No.: US 8,324,822 B2
(45) Date of Patent: Dec. 4, 2012

(54) SYSTEM AND METHOD FOR DIMMABLE CONSTANT POWER LIGHT DRIVER

(75) Inventor: Chunghang Peng, Walnut, CA (US)

(73) Assignee: Ace Power International, Inc. (TW)

( * ) Notice: Subject to any disclaimer, the term of this patent is extended or adjusted under 35 U.S.C. 154(b) by 217 days.

(21) Appl. No.: 12/852,324

(22) Filed: Aug. 6, 2010

(65) Prior Publication Data

US 2012/0032605 A1 Feb. 9, 2012

(51) Int. Cl.

| | |
|---|---|
| ***H05B 37/02*** | (2006.01) |
| ***H05B 39/02*** | (2006.01) |
| ***H05B 39/04*** | (2006.01) |
| ***H05B 41/36*** | (2006.01) |
| ***H05B 37/00*** | (2006.01) |
| ***H05B 39/00*** | (2006.01) |

(52) U.S. Cl. ..... 315/209 R; 315/172

(58) Field of Classification Search ..... 315/209 R, 315/72, 172, 186, 246, 319

See application file for complete search history.

(56) References Cited

U.S. PATENT DOCUMENTS

| | | | | |
|---|---|---|---|---|
| 4,385,347 | A | | 5/1983 | Takematsu |
| 4,471,327 | A | | 9/1984 | Moss |
| 4,685,020 | A | | 8/1987 | Driscoll |
| 4,710,695 | A | | 12/1987 | Yamada et al. |
| 4,740,880 | A | | 4/1988 | Peruth |
| 4,812,959 | A | | 3/1989 | Driscoll et al. |
| 4,939,632 | A | | 7/1990 | Plagge et al. |
| 5,073,850 | A | | 12/1991 | Pace |
| 5,175,675 | A | | 12/1992 | Uramoto |
| 5,515,256 | A | | 5/1996 | Yokoyama |
| 5,650,694 | A | * | 7/1997 | Jayaraman et al. ..... 315/225 |
| 5,699,237 | A | | 12/1997 | Seragnoli |
| 5,751,560 | A | | 5/1998 | Yokoyama |
| 5,850,335 | A | | 12/1998 | Otake |
| 5,852,549 | A | | 12/1998 | Heeringa |
| 6,445,598 | B1 | | 9/2002 | Yamada |
| 7,213,940 | B1 | | 5/2007 | Van De Ven et al. |
| 7,333,353 | B2 | | 2/2008 | Yin |
| D570,537 | S | | 6/2008 | Chan et al. |
| D570,538 | S | | 6/2008 | Chan et al. |
| D570,539 | S | | 6/2008 | Chan |
| D571,497 | S | | 6/2008 | Chan et al. |
| D571,944 | S | | 6/2008 | Pickard |
| D573,294 | S | | 7/2008 | Chan et al. |
| D581,082 | S | | 11/2008 | Chan |
| D581,083 | S | | 11/2008 | Chan |

(Continued)

*Primary Examiner* — Shawki S Ismail
*Assistant Examiner* — Dylan White
(74) *Attorney, Agent, or Firm* — Fountain Law Group, Inc.; George L. Fountain

(57) ABSTRACT

An apparatus is disclosed that is capable of delivering substantially constant power to a luminous load with variation in the input voltage and the environment temperature. The apparatus may be further adapted to vary the power supplied to the luminous load based on changes in the input voltage produced by a phase control dimmer or external device. Additionally, if the input voltage is changed due to a user controlling a dimmer device to control the brightness of the luminous load, the apparatus is able to control the power delivered to the load in response to the dimmer device. Additionally, the apparatus is adapted to allow the luminous output light intensity to be controlled by changes in a remote control voltage source or variable resister and draws near unity power factor power from the AC input throughout the dimming range when not used with phase control dimmer. The remote control or variable resistor can operate simultaneously with a dimmer to achieve multiple controls for the light output.

21 Claims, 6 Drawing Sheets

U.S. PATENT DOCUMENTS

| | | | | |
|---|---|---|---|---|
| D586,942 | S | 2/2009 | Chan et al. | |
| D592,348 | S | 5/2009 | Trott et al. | |
| D596,330 | S | 7/2009 | Pickard et al. | |
| 8,089,216 | B2 * | 1/2012 | Negrete | 315/294 |
| 2007/0064421 | A1 * | 3/2007 | Baba | 362/231 |
| 2007/0108846 | A1 * | 5/2007 | Ashdown | 307/149 |
| 2007/0171145 | A1 | 7/2007 | Coleman et al. | |
| 2007/0195560 | A1 * | 8/2007 | Yasumura | 363/21.01 |
| 2007/0279440 | A1 | 12/2007 | Negley | |
| 2007/0290625 | A1 | 12/2007 | He | |
| 2008/0084700 | A1 | 4/2008 | Van De Ven | |
| 2008/0112168 | A1 | 5/2008 | Pickard et al. | |
| 2008/0130298 | A1 | 6/2008 | Negley | |
| 2008/0137347 | A1 | 6/2008 | Trott et al. | |
| 2008/0278952 | A1 | 11/2008 | Trott et al. | |
| 2008/0278957 | A1 | 11/2008 | Pickard et al. | |
| 2008/0304269 | A1 | 12/2008 | Pickard et al. | |
| 2011/0175532 | A1 * | 7/2011 | Peng | 315/119 |
| 2011/0309760 | A1 * | 12/2011 | Beland et al. | 315/201 |
| 2012/0062136 | A1 * | 3/2012 | Tsai et al. | 315/224 |

* cited by examiner

SYSTEM AND METHOD FOR DIMMABLE CONSTANT POWER LIGHT DRIVER

FIELD

The present invention relates to a system and method for driving a luminous load at substantially constant power level with substantially unity power factor, and at the same time capable of being dimmable by a phase control dimmer or an external device to enable adjustment of the light output.

BACKGROUND

The search for a method to efficiently and practically drive a solid state lighting device has been going on for years. Solid state lighting units operate in a fundamentally different way than incandescent or even fluorescent lamps, and generally are not connectable directly to an alternating current (AC) power line. Rather, ballasts or other driving circuits are used to make existing lighting fixtures operable with solid state lighting units.

Ballast circuitry is often complex and expensive, making solid state lighting fixture expensive to operate. Another drawback of most current solid state lighting device ballast circuits is that their controlling algorithms are based on either regulating the output voltage as a "constant voltage" supply or regulating the output current as a "constant current" supply. The regulated voltage and regulated current approaches often are not capable of working with an AC phase control dimmer.

A typical AC phase control dimmer controls the illumination of a lighting fixture by cutting off a portion of the input AC voltage. This results in a decrease in the rectified input direct current (DC) voltage. A voltage or current regulating ballast will sense the decrease in the input DC voltage by increasing the output voltage or current. This counteracts the dimmer's attempt to lower the illumination of the lighting fixture, thereby rendering the dimmer function inoperable or impractical.

SUMMARY

An aspect of the invention relates to an apparatus for supplying power to a luminous load. The apparatus comprises a sample and hold (S/H) circuit adapted to temporarily generate a first voltage for a defined time interval that is based on an input voltage; a modulator adapted to generate a drive signal comprising a parameter modulated by the first voltage; a switching device adapted to turn on and off based on the drive signal; a transformer adapted to develop a second voltage in response to current produced in a first winding in response to the switching device being turned on and off; and an output circuit adapted to generate a third voltage across the luminous load based on the second voltage.

In another aspect of the invention, the parameter of the drive signal modulated by the first voltage comprises a duty cycle. In yet another aspect, the duty cycle varies inversely with the input voltage. In still another aspect, the drive cycle cycles with a substantially constant frequency.

In another aspect of the invention, the input voltage is based on an input alternating current (AC) voltage, wherein the defined time interval in which the first voltage is temporarily produced by the S/H circuit is related to the period of the AC voltage. In yet another aspect, the apparatus comprises a voltage divider adapted to scale down the input voltage to generate a fourth voltage from which the S/H circuit generates the first voltage.

In another aspect of the invention, the modulator is adapted to vary the parameter of the drive signal in response to variation of the input voltage so that substantially constant power is delivered to the luminous load. In yet another aspect, the modulator is adapted to vary the parameter of the drive signal in response to variation in the environment temperature so that substantially constant power is delivered to the luminous load. In still another aspect, the modulator is adapted to inhibit the modulation of the parameter of the drive signal in response to the input voltage decreasing below a threshold due to a dimmer circuit or external control device, whereupon the power delivered to the luminous load varies with the input voltage.

In another aspect of the invention, the apparatus further comprises an over current protection circuit adapted to affect the drive signal in response to the current in the first winding of the transformer exceeding a defined threshold. In yet another aspect, the transformer comprises a second winding for generating a fourth voltage for powering up at least a portion of the control module. In still another, the apparatus comprises an over voltage protection circuit adapted to affect the drive signal in response to the fourth voltage exceeding a defined threshold. In an additional aspect, the apparatus further comprises an under voltage protection circuit adapted to affect the drive signal in response to the fourth voltage decreasing below a defined threshold. In a further aspect, the apparatus comprises a starting circuit adapted to generate a fifth voltage for powering up at least a portion of the control module during star-up and prior to the formation of the fourth voltage.

In another aspect of the invention, the modulator is adapted to apply spread spectrum modulation to the drive signal. In still another aspect, the second voltage is produced at a second winding of the transformer. In another aspect, the output circuit comprises a rectifier adapted to rectify the second voltage, and a capacitor adapted to filter the rectified second voltage to generate the third voltage. In a further aspect, the output circuit further comprises a voltage clamp adapted to prevent the third voltage from exceeding a defined threshold. In yet another aspect, the apparatus comprises a voltage clamp coupled in parallel with at least a portion of the first winding of the transformer.

In another aspect of the invention, the modulator is adapted to control the power delivered to the luminous load in response to a remote control voltage source or variable resistor in a manner that substantially unity power factor power is drawn from an AC input throughout a dimming range of an AC phase control dimmer. In still another aspect, the modulator is adapted to control the power delivered to the load in response to a remote control voltage source or variable resistor, and simultaneously in response to an AC input phase control dimmer.

Other aspects, advantages and novel features of the present invention will become apparent from the following detailed description of the invention when considered in conjunction with the accompanying drawings.

DETAILED DESCRIPTION OF THE EXEMPLARY EMBODIMENTS

Figure 1:
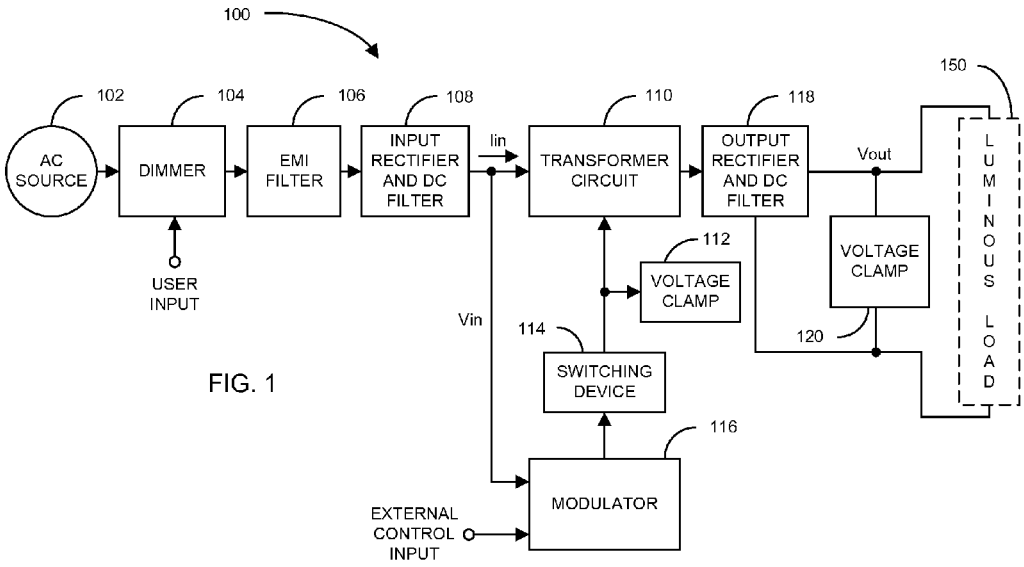
FIG. 1 illustrates a block diagram of an exemplary apparatus for supplying substantially constant power to a luminous load in accordance with an embodiment of the invention.

FIG. 1 illustrates a block diagram of an exemplary apparatus 100 for supplying substantially constant power to a luminous load 150 in accordance with an embodiment of the invention. The system 100 may be an example of a lighting system for a residential, commercial or government application. The apparatus 100 may comprise a utility alternating current (AC) source 102, a dimmer 104, an electromagnetic interference (EMI) filter 106, an input rectifier and direct current (DC) filter 108, a transformer circuit 110, a first voltage clamp 112, a switching device 114, a modulator 116, an output rectifier and DC filter 118, and a second voltage clamp 120. As discussed above, the apparatus 100 supplies regulated or substantially constant power to a luminous load 150, which could be an LED-based, incandescent-based, fluorescent-based, or other type of luminous load.

The AC source 102 supplies power in the form of an alternating voltage (e.g., a substantially sinusoidal voltage), which may have defined or standardized parameters, such as those associated with the North American standard of 60 Hz, 110-120 Volt or the European standard of 50 Hz, 220-240 Volt. The dimmer 104 may be a phase-control type dimmer circuit, which suppresses or cut-outs a portion of the AC voltage based on a user input device (e.g., a dimming control knob) for the purpose of controlling the illumination or brightness of the luminous load 150. The EMI filter 106 reduces extraneous signal interference and noise that may be reflected back to the AC voltage line. The input rectifier and DC filter 108 rectifies the AC voltage from the EMI filter 106 and applies high frequency filtering in order to generate an input DC input voltage Vin for the transformer circuit 110.

The modulator 116 generates a modulated drive signal for the switching device 114, which, in turn, controls the current Iin through the transformer circuit 110 based on the input DC voltage Vin applied to the input of the transformer circuit 110. For example, the modulated drive signal may be a pulse width modulated (PWM) signal. The current, Iin, flowing through an input winding of the transformer circuit 110, is controlled by the PWM drive signal generated by the modulator 116. The modulator 116 is adapted to automatically control the duty cycle of the drive signal applied to the switching device 114, and consequently, the current through the input winding of the transformer circuit 110 in order to control, regulate, or maintain the power delivered to the luminous load 150. The modulator 116 may employ pulse width modulation at a substantially constant frequency to regulate the power delivered to the luminous load 150.

More specifically, the modulator 116 is adapted to maintain the power delivered to the luminous load 150 substantially constant given a defined range for the input DC voltage Vin to the transformer circuit 110 and a defined environment temperature range. Additionally, as discussed in more detail below, the modulator 116 may be configured to allow the dimmer 104 to control the brightness of the luminous load 150 when the dimmer is operated to reduce the light output of the luminous load. In addition, the modulator 116 further includes an external control input to allow control of the illumination or brightness of the luminous load 150 by an external device, such as a remote control or variable-resistance device. The control of the light output of the luminous load 150 may be simultaneously performed by both the external device and the dimmer 104 to provide a two-variable control. As an example, one control may set a maximum light output and the other may be used to lower the light output below the set maximum.

The output rectifier and DC filter 118 rectifies and DC filters the voltage developed across or partially across a winding (e.g., an input and/or output winding) of the transformer circuit 110 in order to produce an output voltage Vout across the luminous load 150. The voltage clamp 120 protects the luminous load 150 when the output voltage Vout spikes or surges above a defined threshold level. The voltage clamp 120 performs this by shunting the load 150 when the output voltage Vout exceeds the defined threshold.

Figure 2:
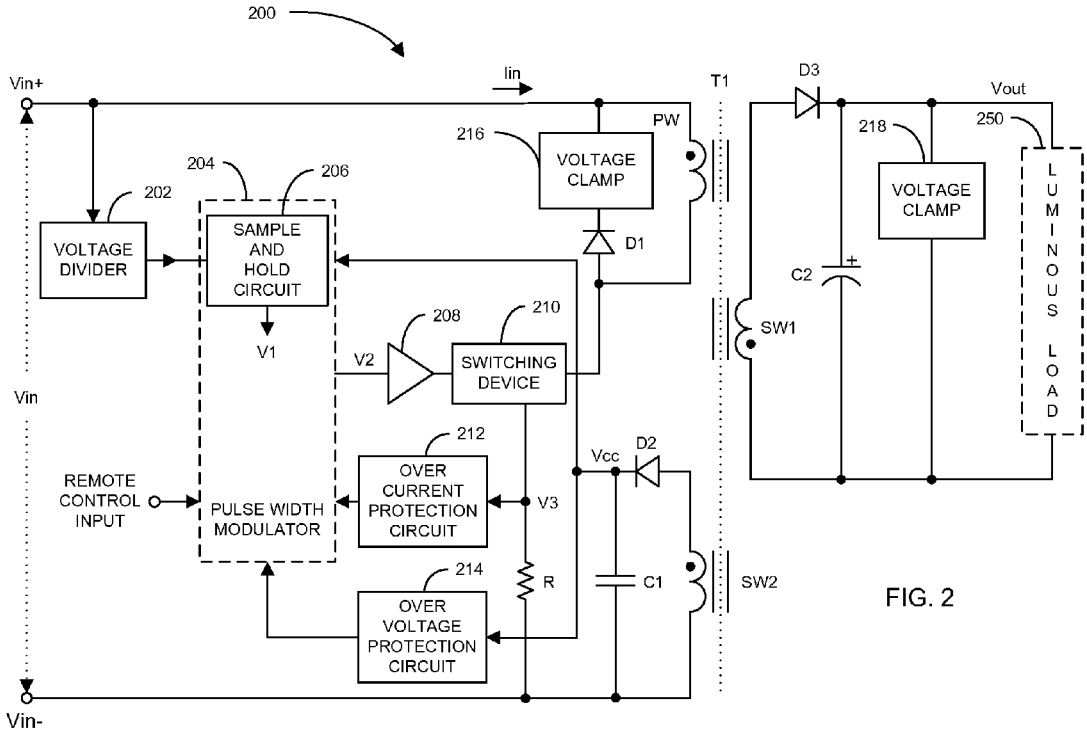
FIG. 2 illustrates a schematic diagram of another exemplary apparatus for supplying substantially constant power to a luminous load in accordance with another embodiment of the invention.

FIG. 2 illustrates a block diagram of an exemplary apparatus 200 for supplying substantially constant power to a luminous load 250 in accordance with another embodiment of the invention. The apparatus 200 comprises an input voltage divider 202, a PWM modulator 204 including an internal sample and hold (S/H) circuit 206, a power switch driver 208, a switching device 210, an over current protection circuit 212, an over voltage protection circuit 214, a transformer T1 including a primary winding (PW) and two secondary windings (SW1 and SW2), a primary voltage clamp 216, and a secondary voltage clamp 218.

The input voltage divider 202 scales down the input DC voltage Vin to a lower level and sends it to the S/H circuit 206 of the PWM modulator 204. It shall be understood that the S/H circuit 206 may be configured separate and/or external to the PWM modulator 204. The S/H circuit 206 generates a voltage V1 based on the peak of the input DC voltage Vin and holds it at that value for a defined time interval (e.g., half a cycle of the input AC voltage). The voltage V1 is used by the PWM modulator 204 to generate a substantially constant frequency PWM drive signal V2 having a duty cycle D based on the input DC voltage Vin. For example, the duty cycle D may be given by the following equation:

$$D=K/Vinpk \text{ or } K=Vinpk*D \quad (1)$$

where K is an experimentally chosen design constant for optimum power transfer and Vinpk is substantially the peak voltage of the input rectified DC voltage Vin.

The drive signal V2 is buffered by the power switch driver 208 to turn on and off the switching device 210. When the switching device 210 is turned on, current Iin flows through the primary winding PW of the transformer T1, the switching device 210, and a current-sensing resister R. The over current protection circuit 212 receives a voltage V3 derived from the current Iin flowing through R. The over current protection circuit 212 initiates an over current protection action in the event of Iin exceeding a defined threshold. The over current protection action may include reducing the duty cycle D of the drive signal V2, reducing the frequency of the drive signal V2, disabling the drive signal V2, completely eliminating the generation of the drive signal V2, and/or others.

The rectifier D2 rectifies and capacitor C1 filters a voltage developed across the secondary winding SW2 of the transformer T1 to generate a DC bias voltage Vcc used to power up electronic circuit modules, such as the modulator 204. The over voltage protection circuit 214 is responsive to the bias voltage Vcc and initiates an over voltage protection action in the event of Vcc exceeding a defined threshold. The over voltage protection action may include reducing the duty cycle D of the drive signal V2, reducing the frequency of the drive signal V2, disabling the drive signal V2, completely eliminating the generation of the drive signal V2, and/or others.

The power switch driver 208 receives the substantially fixed frequency PWM drive signal V2, which is modulated based on the peak of the input DC voltage Vin during each half cycle of the AC input sine wave voltage. The switching device 210 turns on and off based on this duty cycle D of the PWM drive signal V2, which, in turn, regulates the power delivered to the luminous load 250 during each half of the AC input sine wave cycle. The rectifier D3 and capacitor C2 together convert the voltage derived from the output winding SW1 of the transformer T1 to generate an output DC voltage Vout that is applied across the luminous load 250. The primary voltage clamp 216 and diode D1 provide over-voltage protection of the switching device 210 to keep the voltage stress under a safe operating range. The secondary voltage clamp 218 may further provide over-voltage protection of the luminous load 250 by shunting the load in response to the output voltage Vout exceeding a predetermined level.

When the switching device 210 is turned on, the current Iin(t) flows through the primary winding PW of transformer T1 according to the following equation:

$$Iin(t) = \left(\frac{Vin}{L}\right) * t \tag{2}$$

where Vin is the voltage supplied to the transformer T1, L is the inductance of the primary winding PW, and t is the amount of time the switching device 210 is turned on.

The transformer T1 is designed to release substantially all of its stored energy every clock cycle. The magnetic flux stored in the transformer primary winding PW is supplied to the transformer secondary winding SW1 after the switching device 210 turns off. Thus, the peak current in the primary winding in each clock cycle can be expressed according to the following equation:

$$Ipk(t) = \left(\frac{Vin(t)}{L}\right) * D * T \tag{3}$$

where Ipk(t) is the peak current in the primary winding, T is the period of the substantially constant frequency F drive signal V2 (e.g., T=1/F), and Vin(t) is the peak voltage of the input DC voltage Vin at that high frequency clock cycle. Therefore, D*T is the amount of time that the current Iin is flowing through transformer T1. As described below, the total time D*T is a function of the voltage V1, which the S/H circuit 206 maintains at substantially the same level for each half of the AC sine wave cycle.

The energy E(t) stored in the primary winding PW in each switching cycle can be expressed by the following equation:

$$E(t) = \tfrac{1}{2} L * (Ipk(t))^2 \tag{4}$$

Substituting equation 3 into equation 4, the stored energy for each high frequency clock cycle, E(t) can be described as:

$$E(t) = 1/2L * \left(Vin(t) * \frac{D * T}{L}\right)^2 \tag{5}$$

which can be rewritten as:

$$E(t) = 1/2 \frac{(Vin(t) * D * T)^2}{L} \tag{6}$$

Depending on the transformer turn ratio, a substantial portion of the stored energy E can be delivered to the secondary winding SW1, diode D3 and capacitor C2. In one embodiment, on each switching cycle, substantially all of the energy E stored in the primary winding PW is released to the secondary winding SW1. Because the switching frequency is fixed, the power delivered to the luminous load 250 may be calculated as follows:

$$P = E * F \tag{7}$$

Where, F is the substantially constant clock frequency of the drive signal V2 and P is the power transferred to the luminous load 250. Substituting equation 6 into equation 7, the power delivered to the load 250 may be expressed as follows:

$$P(t) = 1/2 \frac{(Vin(t) * D * T)^2}{L} * F \tag{8}$$

Since T=1/F, equation 8 may be rewritten as follows:

$$P(t) = \frac{(Vin(t))^2}{\frac{2L * F}{D^2}} \tag{9}$$

Vin(t) is a rectified sine wave DC voltage, the waveform repeat itself every half of the AC utility sine wave cycle. The power Pac delivered from the AC utility source for that half cycle can be calculated by averaging equation (9) over the half of the AC sine wave cycle:

$$Pac = \int_0^{Tac/2} P(t)/(Tac/2) = \frac{D^2}{2L * F} \int_0^{Tac/2} (Vin(t))^2/(Tac/2) \tag{10}$$

Where Tac is the half of the period of the AC utility voltage cycle and Pac is the average power delivered from the AC input for that time period.

Knowing Vin(t) is a rectified sine wave DC voltage, therefore $$\int_0^{Tac/2} (Vin(t))^2/(Tac/2) = (Vinpk)^2/2 \tag{11}$$

And, from equations 10 and 11

$$Pac = \frac{D^2}{2L * F}(Vinpk)^2/2 = \frac{D^2}{4L * F}(Vinpk)^2 = (Vinpk)^2 \Big/ \left(\frac{4L * F}{D^2}\right) \tag{12}$$

Substituting equation 1 into equation 12, the power delivered to the load 250 may be represented as follows:

$$Pac = \frac{(K)^2}{(4L*F)} \tag{13}$$

Since both F and L may be substantially constant by design, and the input voltage level Vin is not in the power calculation equation, the power (Pac) delivered to the luminous load 250 is substantially constant regardless of the level of input voltage. Also, since the S/H circuit 206 keeps the duty cycle programming voltage V1 substantially constant in each half wave of the AC voltage cycle, the duty cycle D is also constant during this time interval. Accordingly, the effective resistance Reff seen by the AC input circuit during each half wave AC sine wave cycle can be represented by equation:

$$Reff = \frac{4L*F}{D^2} \tag{14}$$

If a pure resistive load were placed across the inputs Vin, instead of the rest of the circuit in FIG. 2, the power delivered (Pd) to the load would be effectively represented by:

$$Pd = \frac{(Vin)^2}{R} \tag{15}$$

The variable R is the resistance value of the resistive load, such as an incandescent light bulb. Note the similarity between equation 15 and equation 13. Thus, the apparatus 200 is emulating a substantially pure resistive load to the AC input and accordingly, is able to achieve relatively high or substantially unity power factor.

Phase controlled dimmers typically are made using thyristor to control the AC input voltage. These types of dimmer are designed to work with a resistive load, such as an incandescent lamp. When a constant voltage or constant current solid state driver with large input capacitance is seen as the load for a thyristor, the thyristor can be falsely triggered on and off, causing an undesirable amount of power to be delivered to the ballast circuit and luminous load. Because the light driver apparatus 200 behaves like a resistive load to the thyristor, the phase controlled dimmer works properly and false triggering is avoided.

Further, the light driver apparatus 200 is configured to properly interface with a phase control dimmer by reducing the power supplied to the luminous load 250 in response to a user controlling the dimmer to reduce the light output. If the phase control dimmer cuts off less than ½ of half the AC sine wave cycle, the voltage V1 continues to be based on the true AC input Vin peak voltage, and the pulse width modulator 204 maintains the duty cycle D substantially unchanged to drive the switching device 210. Thus, in this case, the power delivered to the luminous load 250 is based primarily on input DC voltage Vin, and thus the light output will follow the dimmer control.

When the phase control dimmer cuts off more than ½ of the half AC cycle, the voltage V1 will now be based on a lower than the original AC input peak voltage Vin. In response, the pulse width modulator 204 initially increases the duty cycle D of the driver signal V2 try to maintain the power delivered to the luminous load 250 substantially constant. However, since the phase control dimmer prevents more than ½ of the half AC cycle voltage to reach Vin, even with higher duty cycle, the available power deliver to the luminous load 250 still follows the dimmer control and decreases monotonically.

Continued cutting off of the AC cycle by the dimmer causes the pulse width modulator 204 to increase the duty cycle D to a defined limit or maximum. Further lowering the conduction angle of the input AC voltage by the dimmer causes less power delivered to the luminous load 250 because Vin is still getting smaller, even though the duty cycle D remains substantially constant. Thus, the light driver apparatus 200 is able to maintain substantially constant power delivered to the load 250 when the dimmer is not in play, and reduce the power delivered to the load when the dimmer is in play.

Figure 3A:
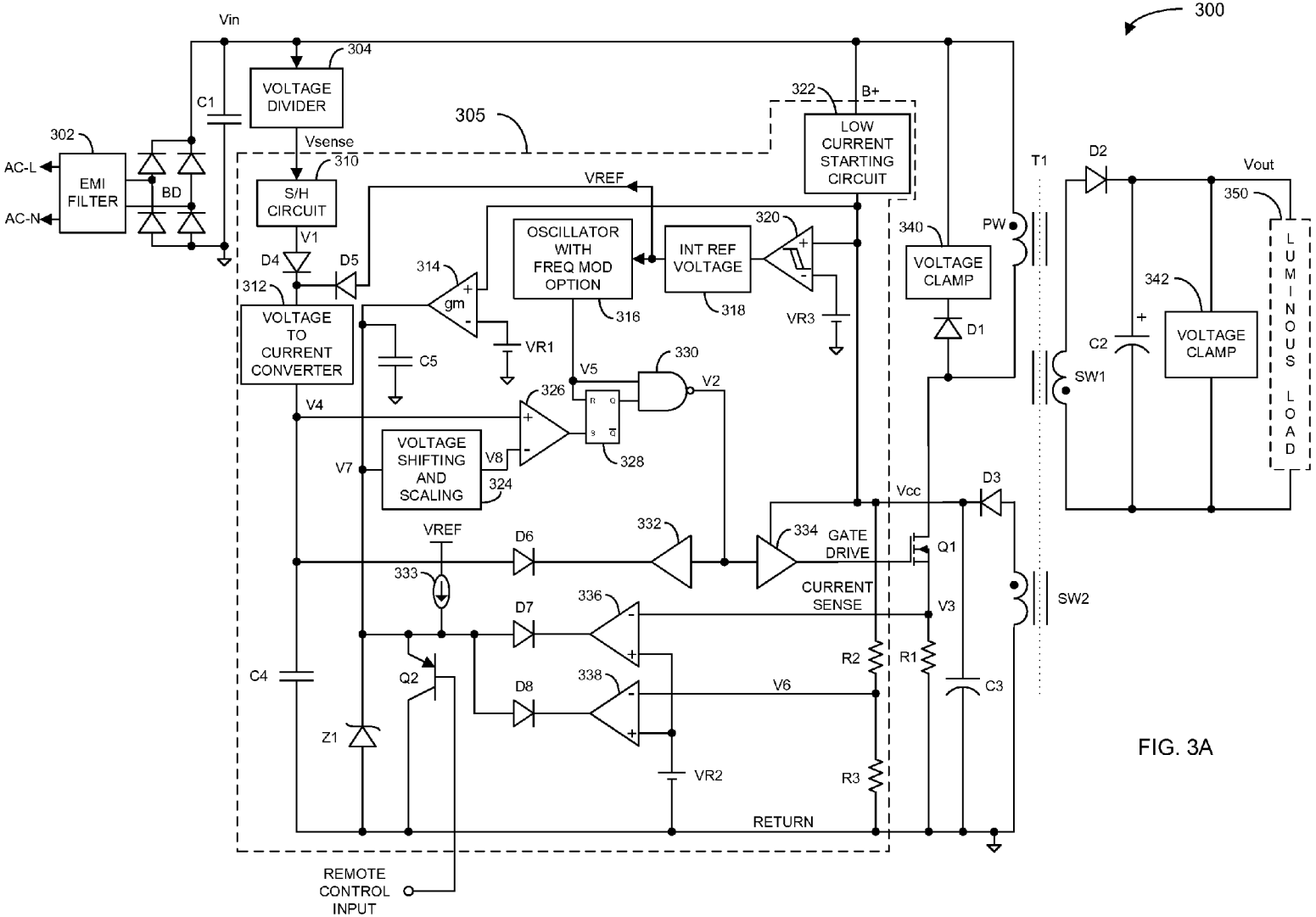
FIGS. 3A-3B respectively illustrate schematic diagrams of other exemplary apparatuses for supplying substantially constant power to a luminous load in accordance with other embodiments of the invention.

FIG. 3A illustrates a detail schematic diagram of another exemplary apparatus 300 for supplying substantially constant power to a luminous load 350 in accordance with another embodiment of the invention. The apparatus 300 comprises an EMI filter 302, rectifying bridge diodes BD, and high-frequency filtering capacitor C1, all of which are adapted to convert an input AC voltage on power line AC-L and AC-N to an input DC voltage Vin. The apparatus 300 further comprises a voltage divider 302 that scales down Vin to produce a voltage Vsense. The apparatus 300 further comprises a control module 305 for controlling the power delivered to the luminous load 350. The control module 305 may include many components as shown within a boundary indicated by dash lines. The control module 305, in turn, comprises a sample and hold (S/H) circuit 310 adapted to sample Vsense and hold it for a defined time interval (e.g., a half cycle of the input AC voltage). The held Vsense, referred to herein as voltage V1, is based or related to the peak of the input DC voltage Vin, but alternatively, may be related to the RMS or other characteristic of the input DC voltage Vin. The voltage V1 is applied to a voltage-to-current converter 312 by way of a diode D4.

The control module 305 further comprises a low current starting circuit 322 adapted to generate a starting current in response to detecting the input DC voltage Vin via input B+ upon the initial power up of the apparatus 300. The starting current flows through resistors R2 and R3 to produce a starting voltage Vcc. The control module 305 further comprises an under voltage control comprising comparator 320 and an internal reference voltage generator 318. In response to the starting voltage Vcc increasing above a threshold voltage VR3, the comparator 320 changes its output from a logic low voltage to a logic high voltage which, in turn, causes the internal reference voltage generator 318 to generate a reference voltage VREF. The reference voltage VREF, in turn, powers up an internal oscillator 316 to cause it to generate a substantially constant frequency clock signal V5. The internal oscillator 316 may include a frequency modulation option so that spread spectrum modulation may be applied to the frequency of the clock signal V5 so as to reduce EMI. The clock signal V5 is applied to a reset input of an RS-latch 328 and an input of a NAND-gate 330.

The reference voltage VREF is also applied to the voltage-to-current converter 312 by way of diode D5. The voltage-to-current converter 312 generates a charging current based on the voltage that is being applied to the converter. For instance, if the voltage V1 is less than the reference voltage VREF, then the voltage-to-current converter 312 generates a charging current based on the reference voltage VREF. On the other hand, if the voltage V1 is greater than the reference voltage VREF, then the voltage-to-current converter 312 generates a charging current based on the voltage V1. In other words, the reference voltage VREF establishes a minimum charging current. The charging current is adapted to charge the capacitor C4 to produce a rising voltage V4. The voltage V4 is applied to a positive input of a comparator 326.

The starting voltage Vcc produced by the starting current flowing through resistors R2 and R3 is applied to a positive input of a transconductance (gm) comparator 314. The transconductance comparator 314 generates a reference current when the starting voltage Vcc is greater than a threshold voltage VR1 applied to a negative input of the transconductance comparator 314. The reference current biases a Zener diode Z1 to generate a voltage V7, which is applied to an input of a voltage shifting and scaling device 324. As discussed in more detail below, the capacitor C5 delays the rise of the voltage V7 so that a soft-start turn on of the switching device Q1 is performed immediately upon start up. The voltage shifting and scaling device 324 produces a threshold voltage V8 that is applied to a negative input of the comparator 326.

The comparator 326 includes an output coupled to a set input of the RS-latch 328. The RS-latch 328 includes a Q-output coupled to another input of the NAND gate 330. The NAND gate 330 produces a pulse width modulated (PWM) drive signal V2. The drive signal V2 is applied to a control input (e.g., gate) of the switching device Q1 by way of a driver 334. The switching device Q1 may be configured as a metal oxide semiconductor field effect transistor (MOSFET) as shown. The drive signal V2 is also directionally fed back to the positive input of the comparator 326 by way of driver 332 and reverse-configured diode D6.

The apparatus 300 further comprises a transformer T1 including a primary winding PW coupled in series with the switching device Q1 and a current-sensing resistor R1 between the Vin terminal and ground or return. The apparatus 300 further comprises a voltage clamp 340 and diode D1 adapted to reduce or prevent voltage stress on the switching device Q1 when the transformer releases energy to the luminous load 350. The current-sensing resistor R3 develops a voltage V3 related to the current in the primary winding PW of the transformer T1.

The transformer T1 further comprises first and second secondary windings SW1 and SW2. During steady-state operations of the apparatus 300, the first secondary winding SW1 of the transformer T1 develops a voltage which is rectified and filtered by respectively diode D2 and capacitor C2 to produce an output voltage Vout across the luminous load 350. The apparatus 300 further comprises a voltage clamp 342 adapted to protect the luminous load 350 from high voltages, such as spikes, by shunting the load when the output voltage Vout exceeds a defined threshold.

Also, during steady-state operation of the apparatus 300, the second secondary winding SW2 also develops a voltage which is rectified and filtered respectively by the diode D3 and capacitor C3 to maintain the DC voltage Vcc after start up. The under voltage protection circuit, namely the comparator 320 and internal reference voltage generator 318, monitors the voltage Vcc during steady-state operation. If the voltage Vcc falls below VR3, the comparator 320 changes its output from a high logic level to a low logic level. This, in turn, causes the internal reference voltage 318 to cease generating the reference voltage VREF, thereby cutting off the power supplied to the oscillator 316. The oscillator 316 thus ceases generating the clock signal V5, and thus the power delivery operation stops. The comparator 320 may be configured to shut down the power delivery based on two low voltage conditions, one during start-up operation (e.g., upon the voltage dropping below 16 Volts) and another during steady-state operation (e.g., upon the voltage dropping below 11 Volts).

The apparatus 300 further comprises an over current protection circuit in the form of a comparator 336 and diode D7. The comparator 336 includes a negative input adapted to receive the voltage V3 at the node between the switching device Q1 and the current-sensing resistor R1. The comparator 336 also includes a positive input coupled to a threshold voltage source VR2. The diode D7 includes an anode coupled to the input of the voltage shifting and scaling device 324 and a cathode coupled to the output of the comparator 336. If the voltage V3 increases above the threshold voltage VR2, meaning that the current through the transformer T1 may be too high, the output of the comparator 336 switches from a high logic level to a low logic level. This lowers the voltage V8 applied to the negative input of the comparator 326 to essentially zero (0) Volt. This causes the comparator 326 to continuously output a high logic level, which ultimately causes the NAND gate V2 to continuously output a low logic level, thereby disabling the drive signal V2 for the switching device Q1.

Additionally, the apparatus 300 comprises an over voltage protection circuit in the form of a comparator 338 and diode D8, which operates similarly to the over current protection circuit. The comparator 338 includes a negative input adapted to receive a voltage V6 at the node between resistors R2 and R3. The comparator 338 also includes a positive input coupled to the threshold voltage source VR2. The diode D8 includes an anode coupled to the input of the voltage shifting and scaling device 324 and a cathode coupled to the output of the comparator 338. If the voltage V6 increases above the threshold voltage VR2, meaning that the voltage applied to the switching device Q1 may be too high, the output of the comparator 338 switches from a high logic level to a low logic level. This lowers the voltage V8 applied to the negative input of the comparator 326 to essentially zero (0) Volt. This causes the comparator 326 to continuously output a high logic level, which ultimately causes the NAND gate V2 to continuously output a low logic level, thereby disabling the drive signal V2 for the switching device Q1.

The apparatus 300 further comprises an external control circuit adapted to provide external control of the duty cycle D of the drive signal V2, and hence, the power delivered to the luminous load 350. The external control circuit includes a current source 333 and a transistor Q2 (e.g., a bipolar transistor) coupled in series between the output of the reference voltage VREF generator 318 and ground or return. The transistor Q2 includes a base adapted to receive a remote control input. The remote control input is adapted to control the resistance of the transistor Q2 so as to lower the voltage V7 below the threshold voltage of the Zener diode Z1. This lowers the voltage V8 applied to the negative input of the comparator 326, which lowers the duty cycle D of the drive signal V2. As previously discussed, the external control may be provided in lieu of or in addition to the power control provided by a dimmer.

During steady-state operation, the voltage-to-current converter 312 generates a current for charging capacitor C4 which is based on the peak of the input DC voltage Vin by way of voltage V1 held by the S/H circuit 310 for a defined time interval. Upon initial charging of the capacitor C4, the voltage V4 is lower than the voltage V8 at the negative input of the comparator 326. This, in turn, causes the NAND gate 330 to produce a drive signal V2 that is in a logic high state. The logic high state causes the switching device Q1 to turn ON, thereby allowing current Iin to flow through the primary winding PW of the transistor T1. The high logic state, also being produced at the output of driver 332, allows the capacitor C4 to be charged.

When the voltage V4 increases above the voltage V8 at the negative input of the comparator 326, the RS-latch 328 sets, and thus causes the NAND gate 330 to produce a drive signal V2 that is in a low logic state. The low logic state causes the switching device Q1 to turn OFF, thereby allowing the energy stored in the primary winding PW of the transformer T1 to be released to the luminous load 350, as previously discussed. The low logic state, now at the output of driver 332, discharges the capacitor C4, thereby bringing voltage V4 below the voltage V8 at the negative input of comparator 326. This cycle continuously repeats at the frequency of the clock signal V5 generated by the oscillator 316. The rate of charging of the capacitor C4, which is a function of the charging current, and ultimately, a function of the peak of the input DC voltage Vin, varies the duty cycle D of the clock signal V2 accordingly. Thus, as discussed above, the duty cycle D may be based on the peak of the input DC voltage Vin in accordance with equation 1.

Figure 3B:
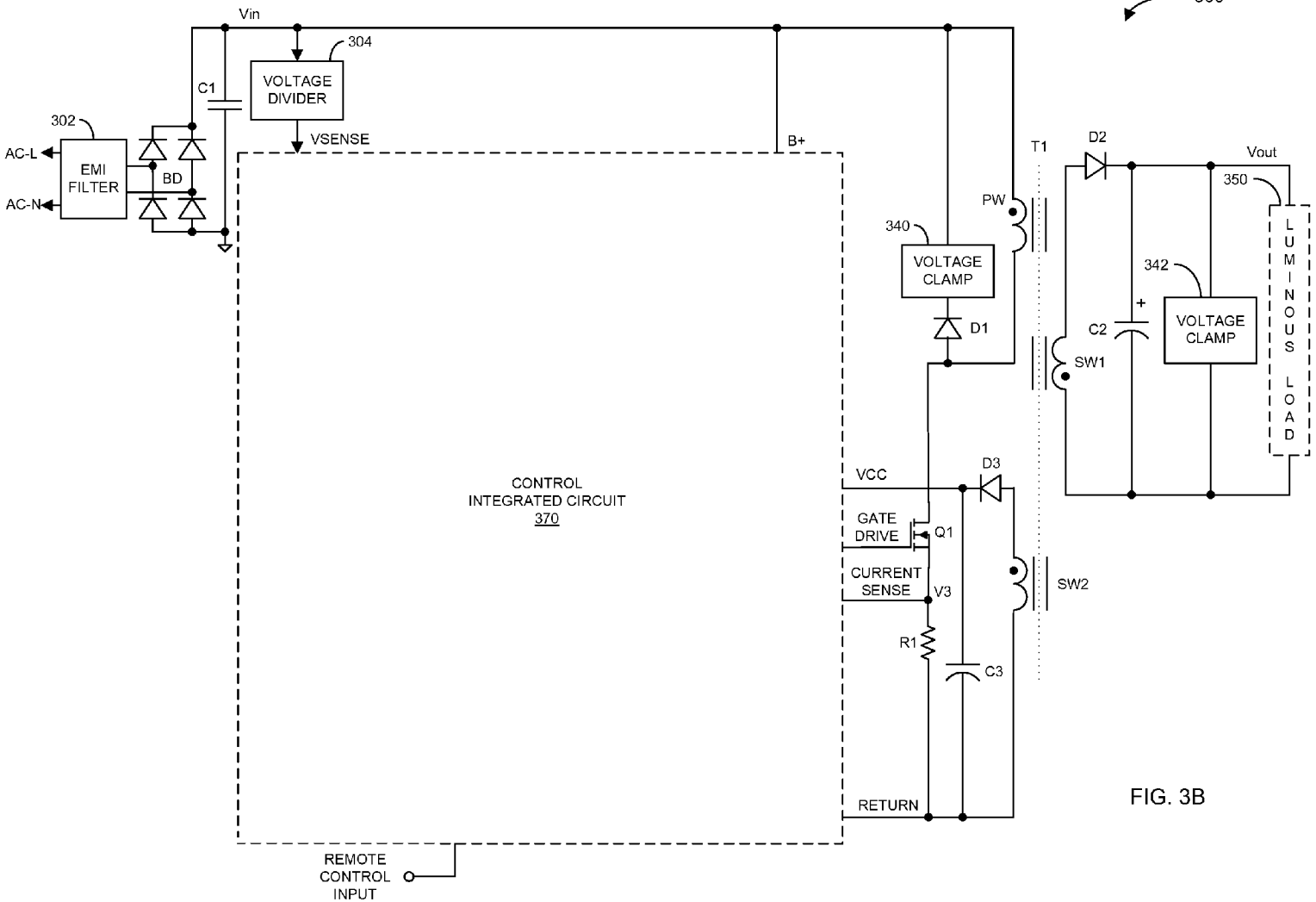

FIG. 3B illustrates a schematic diagram of another exemplary apparatus 360 for supplying power to a luminous load 350 in accordance with another embodiment of the invention. The apparatus 360 is similar to that of apparatus 300, and includes many of the same elements as indicated by the same reference numbers and symbols. The apparatus 360 differs from apparatus 300 in that the components of the control module 305 (shown in FIG. 3A, but not shown in FIG. 3B) are incorporated or integrated into a control integrated circuit (IC) 370. This has the advantage of lowering the component count of the apparatus 360. It shall be understood that any number of discrete components of the apparatus 300 may be incorporated into IC 370.

Figure 4A:
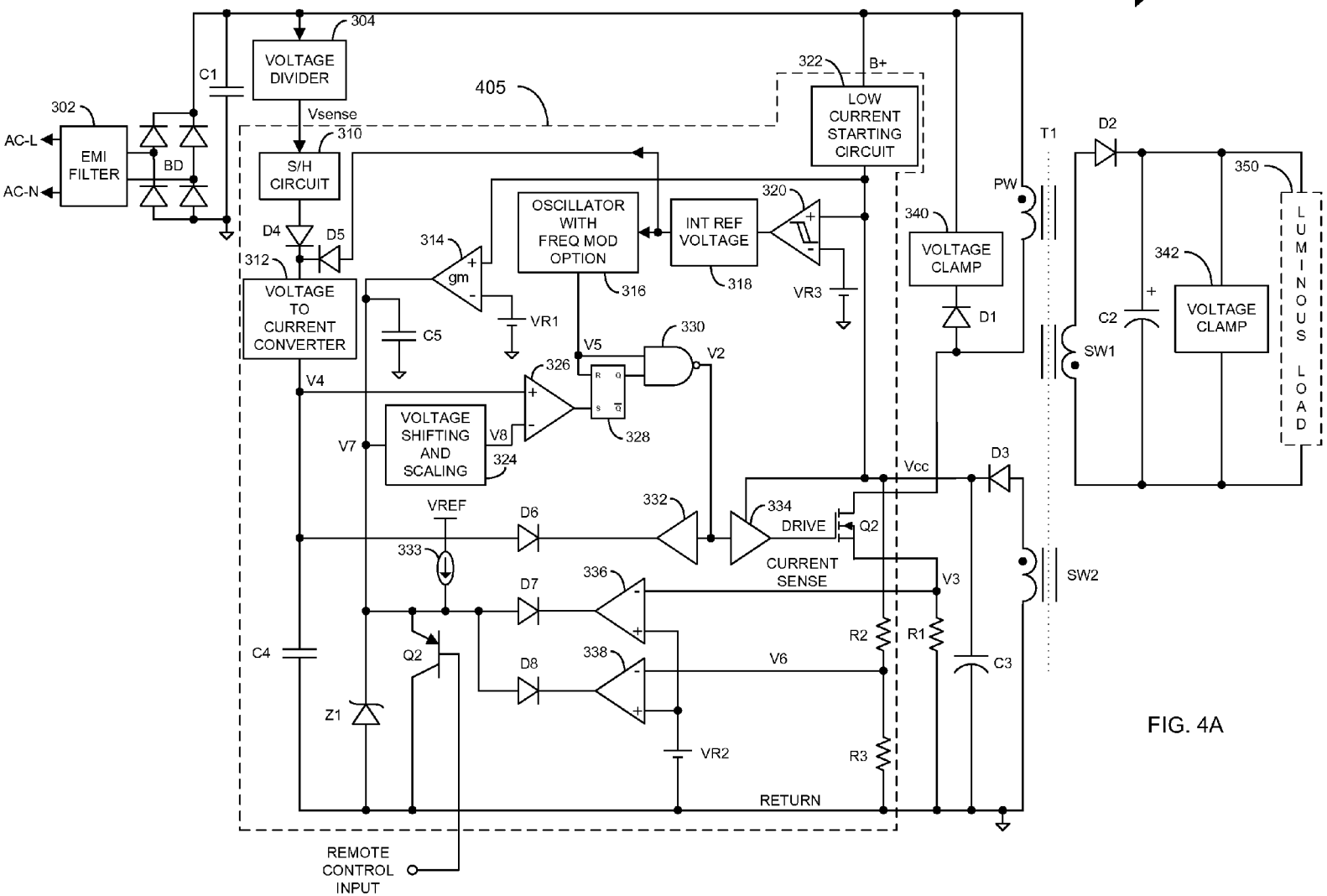
FIGS. 4A-4B respectively illustrate schematic diagrams of other exemplary apparatuses for supplying substantially constant power to a luminous load in accordance with other embodiments of the invention.

FIG. 4A illustrates a schematic diagram of another exemplary apparatus 400 for supplying power to a luminous load 450 in accordance with another embodiment of the invention. The apparatus 400 is similar to apparatus 300 and includes almost all the same elements as denoted with the same reference numbers and symbols. The apparatus 400 differs from apparatus 300 only in further integrating the switching device Q1 (e.g., the power MOSFET) into a control module 405 to reduce the component count of the apparatus.

Figure 4B:
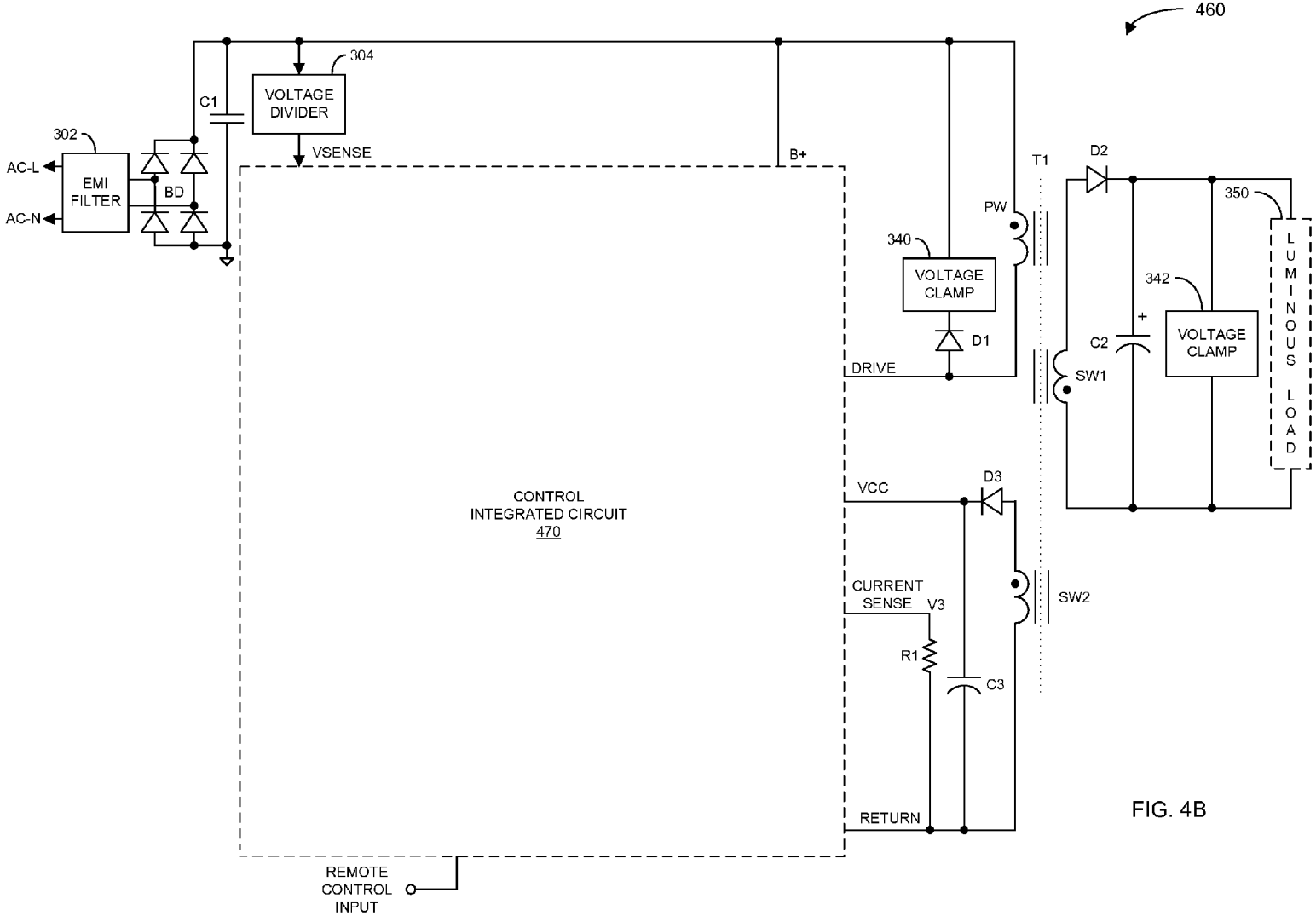

FIG. 4B illustrates a schematic diagram of another exemplary apparatus 460 for supplying power to a luminous load 350 in accordance with another embodiment of the invention. The apparatus 460 is similar to that of apparatus 400, and includes many of the same elements as indicated by the same reference numbers and symbols. The apparatus 460 differs from apparatus 400 in that components of the control module 405 are incorporated or integrated into a control integrated circuit (IC) 470. This has the advantage of lowering the component count of the apparatus. It shall be understood that any number of discrete components of the apparatus 460 may be incorporated into IC 470.

Figure 5:
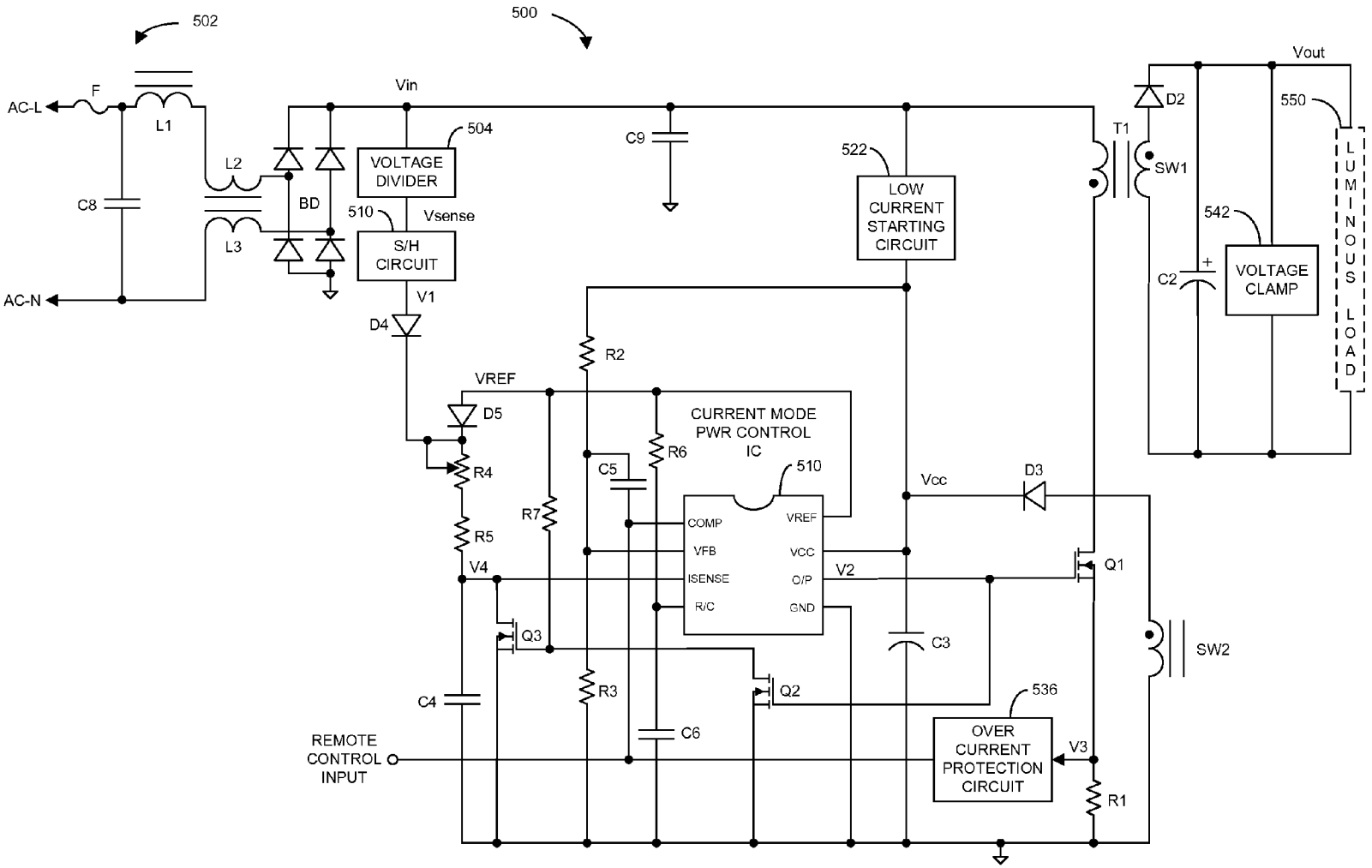
FIG. 5 illustrates a schematic diagram of another exemplary apparatus for supplying substantially constant power to a luminous load in accordance with another embodiment of the invention.

FIG. 5 illustrates a schematic diagram of another exemplary apparatus 500 for supplying substantially constant power to a luminous load 550 in accordance with the embodiments of the invention. The apparatus 500 accomplishes essentially the circuit functions explained with reference to apparatuses previously discussed using industry existing current mode PWM control IC 510 with other discrete components. In particular, the IC 510 may be a Texas Instrument (TI) model UC3842 series current mode PWM controller.

More specifically, the apparatus 500 comprises an EMI filter 502 including capacitor C8 and inductors L1, L2 and L3. The capacitor C8 is coupled across the AC-L and AC-N lines of the AC power line. The inductors L1 and L2 are coupled in series between the AC power line AC-L and rectifying bridge diodes BD. A fuse F may be provided between the AC power line AC-L and inductor L1. The inductor L3 is coupled between the AC power line AC-N and the rectifying bridge diodes BD. The rectifying bridge diodes BD and a capacitor C9 are adapted to rectify and high-frequency filter the AC voltage to generate an input DC voltage Vin. The apparatus 500 also includes a voltage divider 504 to scale down the input DC voltage Vin to generate a voltage Vsense, and a sample and hold (S/H) circuit 510 adapted to sample and hold the voltage Vsense for a defined time interval (e.g., half a cycle of the input AC voltage) to produce a voltage V1.

The voltage V1 serves to charge a capacitor C4 by way of a diode D4, variable resistor R4 and fixed resistor R5. The variable resistor R4 allows for adjustment of the charging current for capacitor C4 to tune the power delivery control as desired. The PWM power control IC 510 includes a REF output adapted to produce a reference voltage VREF also to be applied to the capacitor C4 by way of diode D5 and resistors R4 and R5. Similar to the previous embodiments, the reference voltage VREF sets the minimum charging current for the capacitor C4. This occurs when the voltage V1 is less than VREF.

The PWM power control IC 510 includes an ISENSE input adapted to receive the rising and falling voltage V4 across the capacitor C4. The PWM power control IC 510 includes an internal comparator for comparing the voltage V4 with a reference voltage related to a voltage applied to a VFB input of the IC. Such voltage at the VFB input is initially produced by a low current starting circuit 522 generating a current upon start-up that flows through resistors R2 and R3, and produced during steady-state operation by a voltage Vcc generated from a secondary winding SW2 and rectified and filtered by diode D3 and capacitor C3, respectively. The voltage Vcc also serves to supply DC power to the IC 510 via its VCC input. The capacitor C5 connected between the VFB and COMP inputs of the IC 510 delays the rise of the voltage applied to the VFB input so that a soft-start turn on of the switching device Q1 is immediately performed upon start up.

The drive signal V2 for the switching device Q1 is generated at the O/P output of the IC 510. The drive signal V2 has a substantially constant frequency set by the R-C time constant of resistor R6 and capacitor C6 coupled between the VREF output and ground, wherein the node between the resistor R6 and capacitor C6 is coupled to an R/C input of the IC. The IC 510 also includes a ground terminal GND for grounding the IC circuitry.

The apparatus 500 includes a feedback network adapted to control the duty cycle D of the drive signal V2 so that it is based on the peak of the input DC voltage Vin. In particular, the feedback network includes switching device Q2 (e.g., a MOSFET), switching device Q3 (e.g., another MOSFET), and resistor R7. When the drive signal V2 is at a high logic level, the switching device Q2 is turned ON. The turning ON of switching device Q2, in turn, causes the switching device Q3 to turn OFF. This allows the capacitor C4 to charge up. When the voltage V4 crosses the threshold of the internal comparator of the IC 510, the drive signal V2 changes to a low logic level. This causes the switching device Q2 to turn OFF, which, in turn, causes the switching device Q3 to turn ON by the reference voltage VREF being applied to the gate of the device via resistor R7. The turning ON of switching device Q3 causes a discharge of the capacitor C4. The duty cycle D of the drive signal V2 is thus related to the charging of the capacitor C4, which is a function of the peak of the input DC voltage Vin.

The apparatus 500 further comprises an over current protection circuit 536 including an input adapted to receive a voltage V3 produced at a node between the switching device Q1 and a current-sensing resistor R1. The voltage V3 is related to the current in a primary winding PW of the transformer T1. The over current protection circuit 536 includes an output coupled to the COMP input of the IC 510. The COMP input allows direct controlling of the threshold associated with the internal comparator of the IC 510. If the over current protection circuit 536 detects that the current in the primary winding PW of the transformer is too high, it will generate a relatively low voltage (e.g., ~GND) for the COMP input of the IC 510. This locks the drive signal V2 at the low logic level, thereby turning OFF the switching device Q1. The COMP input of the IC 510 may also serve as a remote control input to allow external control of the duty cycle D by direct adjustment of the threshold of the internal comparator of the IC 510.

The output circuitry of the apparatus 500 is similar to the apparatuses previously discussed. It includes a secondary winding SW1 of the transformer T1 to develop a voltage during the cycle when the switching device Q1 is turned OFF. This voltage is rectified by diode D2 and filtered by capacitor C2 to generate an output voltage Vout for the luminous load 550. The apparatus 500 also includes a voltage clamp 542 to protect the luminous load from harmful high voltages, such as spikes.

While the invention has been described in connection with various embodiments, it will be understood that the invention is capable of further modifications. This application is intended to cover any variations, uses or adaptation of the invention following, in general, the principles of the invention, and including such departures from the present disclosure as come within the known and customary practice within the art to which the invention pertains.

What is claimed is:

1. An apparatus for supplying power to a luminous load, comprising:

a sample and hold (S/H) circuit adapted to temporarily generate a first voltage for a defined time interval, wherein the first voltage is based on an input voltage;

a modulator adapted to generate a drive signal including a parameter modulated by the first voltage, wherein the modulator is adapted to restrict modulation of the parameter of the drive signal in response to the input voltage decreasing below a threshold due to a dimmer circuit, whereupon the power delivered to the luminous load varies with the input voltage;

a switching device adapted to turn on and off based on the drive signal;

a transformer adapted to develop a second voltage in response to current produced in a first winding of the transformer in response to the switching device being turned on and off; and an output circuit adapted to generate a third voltage across the luminous load based on the second voltage.

2. The apparatus of claim 1, wherein the parameter of the drive signal modulated by the first voltage comprises a duty cycle.

3. The apparatus of claim 2, wherein the duty cycle D of the drive signal varies inversely with the input voltage.

4. The apparatus of claim 1, wherein the drive signal cycles with a substantially constant frequency.

5. The apparatus of claim 1, wherein the input voltage is based on an input AC voltage, and wherein the defined time interval is related to a period of the input AC voltage.

6. The apparatus of claim 1, further comprising a voltage divider adapted to scale down the input voltage to generate a fourth voltage that the S/H circuit samples to generate the first voltage.

7. The apparatus of claim 1, wherein the modulator is adapted to vary the parameter of the drive signal in response to variation of the input voltage to deliver substantially constant power to the luminous load.

8. The apparatus of claim 1, wherein the modulator is adapted to vary the parameter of the drive signal in response to variation in an environment temperature to deliver substantially constant power to the luminous load.

9. The apparatus of claim 1, further comprising an over current protection circuit adapted to affect the drive signal in response to the current in the winding of the transformer exceeding a defined threshold.

10. The apparatus of claim 1, wherein the transformer comprises a second winding adapted to generate a fourth voltage for powering up at least a portion of the modulator.

11. The apparatus of claim 10, further comprising an over voltage protection circuit adapted to affect the drive signal in response to the fourth voltage exceeding a defined threshold.

12. The apparatus of claim 1, wherein the modulator is adapted to apply spread spectrum modulation to the drive signal.

13. The apparatus of claim 1, wherein the second voltage is produced at a second winding of the transformer.

14. The apparatus of claim 13, wherein the output circuit comprises:

a rectifier adapted to rectify the second voltage; and a capacitor adapted to filter the rectified second voltage to generate the third voltage.

15. The apparatus of claim 1, wherein the output circuit further comprises a voltage clamp adapted to prevent the third voltage from exceeding a defined threshold.

16. The apparatus of claim 1, further comprising a voltage clamp coupled in parallel with at least a portion of the first winding of the transformer.

17. The apparatus of claim 1, wherein the modulator is adapted to control the power delivered to the luminous load in response to a remote control voltage source or variable resistor in a manner that substantially unity power factor power is drawn from an AC input throughout a dimming ranges.

18. The apparatus of claim 1, wherein the modulator is adapted to control the power delivered to the load in response to a remote control voltage source or variable resistor, and simultaneously in response to an AC input phase control dimmer.

19. An apparatus for supplying power to a luminous load, comprising:

a sample and hold (S/H) circuit adapted to temporarily generate a first voltage for a defined time interval, wherein the first voltage is based on an input voltage;

a modulator adapted to generate a drive signal including a parameter modulated by the first voltage;

a switching device adapted to turn on and off based on the drive signal;

a transformer adapted to develop a second voltage in response to current produced in a first winding of the transformer in response to the switching device being turned on and off, wherein the transformer comprises a second winding adapted to generate a fourth voltage for powering up at least a portion of the modulator;

an output circuit adapted to generate a third voltage across the luminous load based on the second voltage; and an under voltage protection circuit adapted to affect the drive signal in response to the fourth voltage decreasing below a defined threshold.

20. An apparatus for supplying power to a luminous load, comprising:

a sample and hold (S/H) circuit adapted to temporarily generate a first voltage for a defined time interval, wherein the first voltage is based on an input voltage;

a modulator adapted to generate a drive signal including a parameter modulated by the first voltage;

a switching device adapted to turn on and off based on the drive signal;

a transformer adapted to develop a second voltage in response to current produced in a first winding of the transformer in response to the switching device being turned on and off, wherein the transformer comprises a second winding adapted to generate a fourth voltage for powering up at least a portion of the modulator;

an output circuit adapted to generate a third voltage across the luminous load based on the second voltage; and a starting circuit adapted to generate a fifth voltage for temporarily powering up at least a portion of the modulator during start-up and prior to the formation of the fourth voltage.

21. An apparatus for supplying power to a luminous load, comprising:

a modulator adapted to generate a drive signal including a parameter modulated based on a first voltage, wherein the modulator is adapted to restrict modulation of the parameter of the drive signal in response to the first voltage decreasing below a threshold due to a dimmer circuit, whereupon the power delivered to the luminous load varies with the first voltage;

a switching device adapted to turn on and off based on the drive signal;

a transformer adapted to develop a second voltage in response to current produced in a first winding of the transformer in response to the switching device being turned on and off; and an output circuit adapted to generate a third voltage across the luminous load based on the second voltage.

* * * * *